US009789595B2

(12) United States Patent
Hoshino et al.

(10) Patent No.: US 9,789,595 B2
(45) Date of Patent: Oct. 17, 2017

(54) FASTENER DRIVING TOOL

(71) Applicant: MAX CO., LTD., Tokyo (JP)

(72) Inventors: Takamichi Hoshino, Tokyo (JP); Kousuke Moriwaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 420 days.

(21) Appl. No.: 14/318,919

(22) Filed: Jun. 30, 2014

(65) Prior Publication Data

US 2015/0014389 A1 Jan. 15, 2015

(30) Foreign Application Priority Data

Jul. 4, 2013 (JP) ..... 2013-140475

(51) Int. Cl.
*B25C 1/00* (2006.01)

(52) U.S. Cl.
CPC ..... *B25C 1/003* (2013.01)

(58) Field of Classification Search
CPC ..... B25C 1/06; B25F 5/00
USPC ..... 227/8, 119, 120, 130, 136
See application file for complete search history.

(56) References Cited

U.S. PATENT DOCUMENTS 4,442,965 A * 4/1984 Leistner ..... B25C 1/003 227/130
4,863,089 A * 9/1989 McCardle ..... B25C 1/003 227/116
4,942,996 A * 7/1990 Wolfberg ..... B25C 1/003 227/128
5,240,161 A * 8/1993 Kaneko ..... B25C 1/003 227/109
5,683,024 A * 11/1997 Eminger ..... B25C 1/00 227/113
6,308,880 B1 * 10/2001 Ronconi ..... B25C 1/003 227/119
7,938,303 B2 * 5/2011 Tamura ..... B25C 1/008 227/10
2008/0314951 A1 * 12/2008 Kosuge ..... B25C 1/08 227/10

(Continued)

FOREIGN PATENT DOCUMENTS

CN A-102814786 12/2012
JP U-S60-17969 2/1985

(Continued)

*Primary Examiner* — Nathaniel Chukwurah
(74) *Attorney, Agent, or Firm* — Drinker Biddle & Reath LLP

(57) ABSTRACT

A fastener driving tool includes a nose portion, a supply passage and a fastener supply mechanism. The nose portion includes an injection passage for injecting a fastener. The supply passage is connected to the injection passage. The fastener supply mechanism feeds connected fasteners to the injection passage. The fastener supply mechanism includes a feed member which advances and retreats in a feed direction and which oscillates in a direction to retreat from the supply passage. The feed member includes a feed tooth which feeds the fastener to the injecting passage by engaging with a rear portion of the fastener and an auxiliary tooth which is disposed on a foot side of the fastener to prevent the fastener from deviating from the injection passage. When the feed tooth of the feed member projects into the supply passage, the auxiliary tooth projects into the supply passage longer than the feed tooth.

3 Claims, 5 Drawing Sheets

(56) References Cited

U.S. PATENT DOCUMENTS

| | | | | |
|---|---|---|---|---|
| 2009/0057365 | A1* | 3/2009 | Murayama | B25C 1/08<br>227/10 |
| 2010/0176175 | A1 | 7/2010 | Tamura et al. | |

FOREIGN PATENT DOCUMENTS

| | | | |
|---|---|---|---|
| JP | UM-A-S60-022277 | | 2/1985 |
| JP | U-S62-92171 | | 6/1987 |
| JP | H05-44059 | Y2 | 11/1993 |
| JP | A-2001-62753 | | 3/2001 |

* cited by examiner

FASTENER DRIVING TOOL

CROSS-REFERENCE TO RELATED APPLICATION

This application is based on and claims priority under 35 USC 119 from Japanese Patent Application No. 2013-140475 filed on Jul. 4, 2013.

TECHNICAL FIELD

The invention relates to a fastener driving tool using connected fasters and, specifically, it relates to a fastener driving tool characterized by a method for solving the poor feed of the connected fasteners.

BACKGROUND

As a conventional driving tool, there is known a tool including a feed member which can advance and retreat in the feed direction of connected fasters and can be oscillated in a direction to retreat from the supply passage of the connected fasters (see, for example, JP-Y-05-044059). Such feed member includes feed teeth engageable with the second one of the connected fasteners, and feeds the second fastener while holding it by the feed teeth to thereby position the first fastener at a drive-out position in a nose portion. The feed member advances and retreats in linking with a fastener injection operation. For example, in a pneumatic driving tool, after the feed member is retreated with pneumatic pressure in the fastener injection time, the feed member is returned with the energizing force of an energizing member. In this case, the feed member, when retreating, is oscillated in the retreat direction and is thereby prevented from being engaged with the connected fasteners, while, when advancing, it grips the second fastener and feeds it forward.

Also, the feed member guides the rear side of the driven-out first fastener in order to prevent it from deviating from an injection passage, and thus plays a part to close the injection passage (see "inclined surface 11" described in JP-Y-05-044059).

SUMMARY

In the above conventional driving tool, in a state where the feed member has not retreated completely, when it returns and advances, in some cases, the feed teeth cannot pick up the second fastener but the fastener can be fed while the feed teeth have moved onto the shaft portion of the fastener. In this case, since the feed member is slightly oscillated in the retreat direction (a state where the feed teeth are opened), the rear side of the first fastener cannot be guided sufficiently. In this state, the injection passage is not closed with respect to the first fastener, thereby raising a possibility that the driven-out first fastener can be deviated from the injection passage.

Thus, it is an object of the invention to provide a fastener driving tool which, even when the first fastener is driven out in a state where it is fed while the feed teeth have moved onto the shaft portion of the fastener, can prevent the driven-out first fastener from deviating from the fastener injection passage.

This invention is provided to solve the above object and this invention is characterized as below.

The invention described in embodiment 1 is characterized as below.

A fastener driving tool includes a nose portion, a supply passage and a fastener supply mechanism. The nose portion includes an injection passage for injecting a fastener. The supply passage is connected to the injection passage. The fastener supply mechanism feeds connected fasteners loaded into the supply passage to the injection passage. The fastener supply mechanism includes a feed member which advances and retreats in a feed direction of the connected fasteners and which oscillates in a direction to retreat from the supply passage. The feed member includes a feed tooth which feeds out the fastener to the injecting passage by engaging with a rear portion of the fastener in the feed direction and an auxiliary tooth which is disposed on a foot side of the fastener to prevent the fastener from deviating from the injection passage. When the feed tooth of the feed member projects into the supply passage, the auxiliary tooth projects into the supply passage longer than the feed tooth.

The invention described in embodiment 2 is characterized as below in addition to the above invention described in embodiment 1.

The auxiliary tooth is disposed nearer to the foot side of the fastener than a connecting portion of the connected fasteners.

The invention described in embodiment 3 is characterized as below in addition to the above invention described in embodiment 1 or embodiment 2.

The auxiliary tooth extends to the foot side of the fastener with respect to the feed tooth.

The invention according to embodiment 1 is as described above. Specifically, the feed member includes the feed tooth engageable with the rear portion of the fastener to feed out the fastener to the injection passage and the auxiliary tooth disposed on the foot side of the fastener to prevent the fastener from deviating from the injection passage. When the feed tooth of the feed member projects into the supply passage, the auxiliary tooth projects more into the supply passage than the feed tooth. Thus, even when the first fastener is driven out with the feed tooth moved up on the shaft portion of the fastener, since the auxiliary tooth projects into the supply passage, the driven-out first fastener can be prevented from deviating from the injection passage.

That is, when the fastener is fed with the feed tooth moved up on the shaft portion of the fastener, the maximum clearance between the feed tooth and supply passage is substantially equal to the width of the shaft portion of the fastener. And, since the auxiliary tooth projects more into the supply passage than the feed tooth, the clearance between the auxiliary tooth and supply passage is smaller than the width of the shaft portion of the fastener. This prevents the fastener from deviating from the clearance between the auxiliary tooth and supply passage.

And, since the auxiliary tooth projects more into the supply passage than the feed tooth, the clearance between the auxiliary tooth and supply passage is smaller than the diameter of the fastener, the fastener can be surely prevented against deviation.

The invention according to embodiment 2 is as described above. Specifically, since the auxiliary tooth is disposed nearer to the foot side than the connecting portion of the connected fasteners, the fastener driven out obliquely can be surely prevented from deviating out of the injection passage from the foot thereof.

The invention according to embodiment 3 is as described above. Specifically, since the auxiliary tooth is extended to the foot side of the fastener more than the feed tooth, the fastener driven out obliquely can be surely prevented from deviating out of the injection passage from the foot thereof.

BRIEF DESCRIPTION OF THE DRAWINGS

FIG. 4A shows a state where a fastener is fed normally, FIG. 4B shows a state where the fastener is fed with a feed tooth moved up on the shaft portion of the fastener, and FIG. 4C shows a state where the feed tooth has retreated from the fastener supply passage completely.

DETAILED DESCRIPTION

Description is given of an embodiment of the invention with reference to the drawings.

Figure 1:
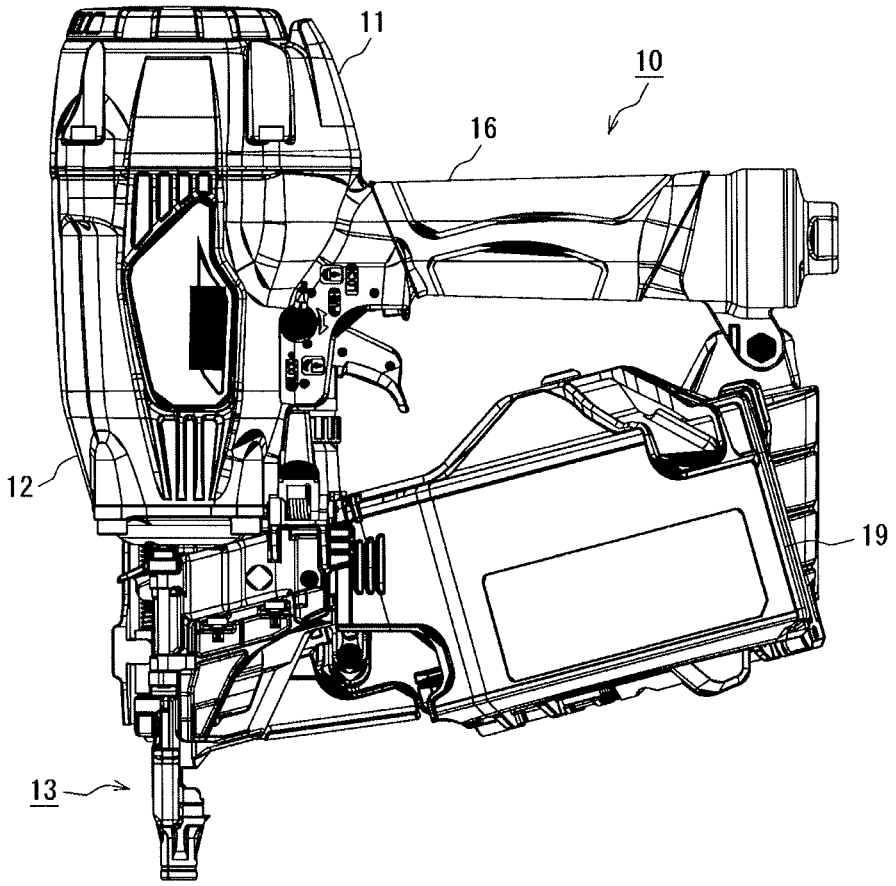
FIG. 1 is a side view of a fastener driving tool.

A fastener driving tool 10 according to the embodiment as the pneumatic driving tool drives fasteners 41 using compressed air and, as shown in FIG. 1, it includes a tool main body 11 having a nose portion 13 and a magazine 19 connected to the tool main body 11 laterally of the nose portion 13.

The tool main body 11 includes a body housing 12 and a grip housing 16 connected to each other substantially at right angles. The body housing 12 includes therein a hitting cylinder with a hitting piston slidably stored therein. The hitting piston includes on its lower surface a driver 21 connected thereto for hitting the fasteners 41, whereby, when the hitting piston operates, the fasteners 41 can be driven by the driver 21.

The nose portion 13 for injecting the fasteners 41 is formed in the lower leading end of the body housing 12, while the driver 21 is guided to be slidable in the direction of the nose portion 13.

Figure 2:
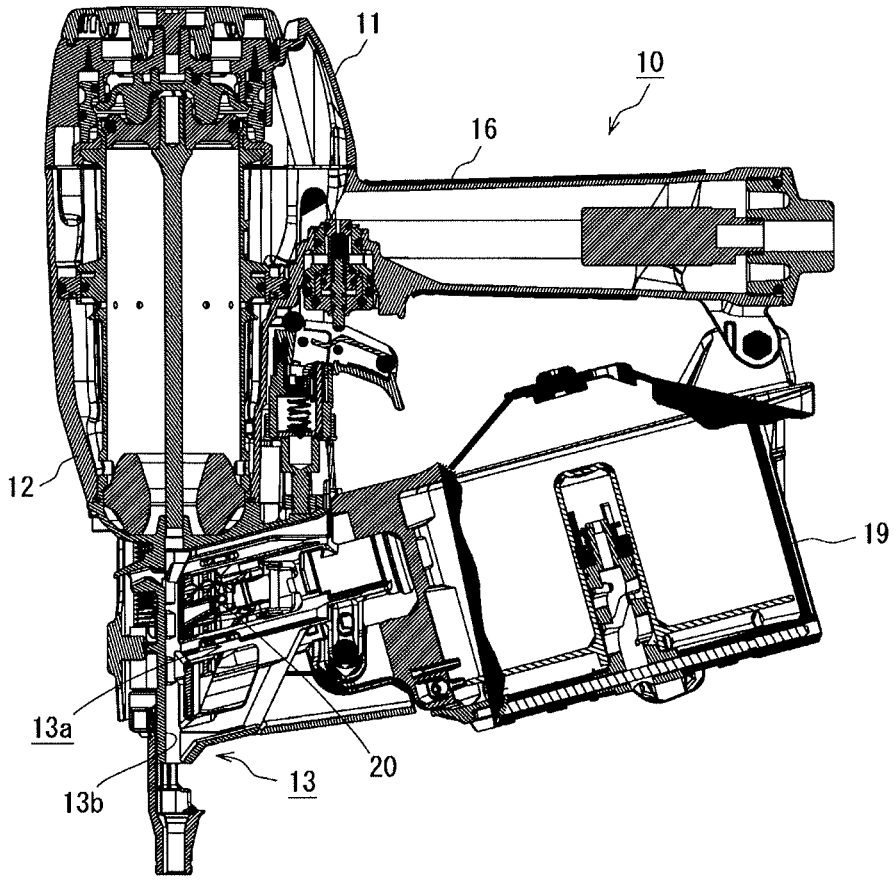
FIG. 2 is a section view of the fastener driving tool when viewed from the side surface thereof.

As shown in FIG. 2, the nose portion 13 includes in its rear portion a supply passage 13*a* to supply the fasteners 41 into the injection passage 13*b* of the nose portion 13. The supply passage 13*a* communicates with the inside of the magazine 19, while the connected fasteners pulled out from the side portion of the magazine 19 are supplied through the supply passage 13*a* to the injection passage 13*b* of the nose portion 13. Here, in the magazine 19, there are stored connected fasteners produced by connecting the multiple fasteners 41 together by a connecting member and winding them in a coil-like shape.

Figure 3:
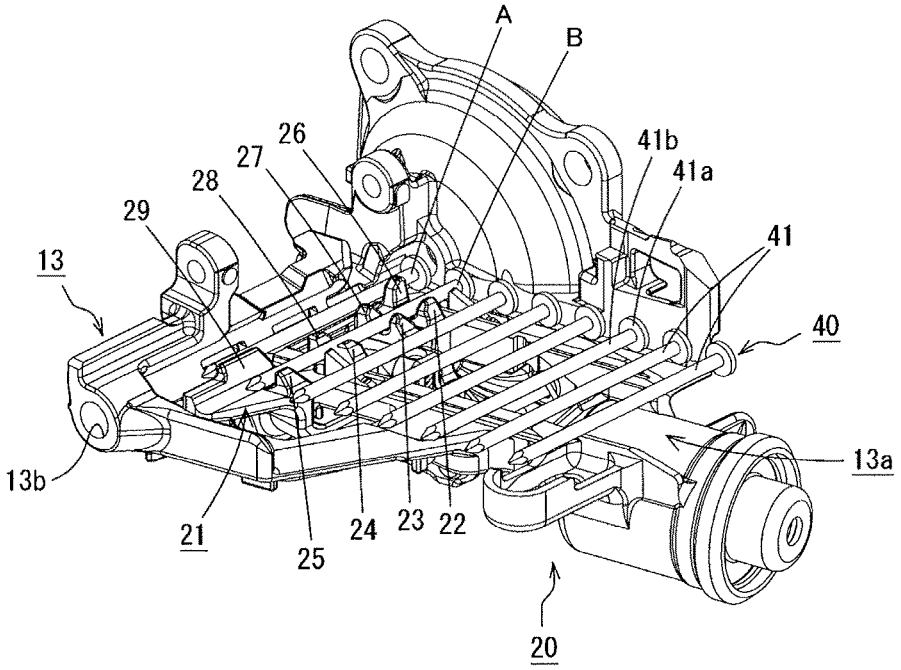
FIG. 3 is a perspective view of a fastener supply mechanism.

The supply passage 13*a* also includes such a fastener supply mechanism 20 as shown in FIG. 3. The fastener supply mechanism 20 includes a feed member 21 for supplying the fasteners 41 sequentially to the nose portion 13. The feed member 21 advances and retreats in linking with the driving operation. Specifically, it advances and retreats in the feed direction of connected fasteners 40 while gripping the shaft portions 41*b* of the fasteners 41, thereby executing a feed operation to supply the connected fasteners 40 within the magazine 19 into the injection passage 13*b* of the nose portion 13 sequentially. Due to such feed operation of the feed member 21, the first fasteners A of the connected fasteners 40 arranged along the supply passage 13*a* are sequentially supplied to the driving position (within the injection passage 13*b*).

The feed member 21 can oscillate in a direction to retreat from the supply passage 13*a*. That is, as shown in FIG. 4, can oscillate about an oscillation shaft 30 disposed on the upstream side of the feed direction of the connected fasteners 40. Thus, when the feed member 21 moves in a direction to move back relative to the feed direction of the connected fasteners 40, it oscillates in the direction to retreat from the supply passage 13*a*, whereby they are prevented from being engaged with the connected fasteners 40. Since the feed member 21 is allowed to oscillate in this manner, when it moves back, the connected fasteners 40 are prevented against reverse feeding.

The feed member 21 operates in the following manner.

Firstly, the feed member 21 moves back at the air pressure of the fastener injection time according to a known structure. In this case, since the feed member 21 oscillates in the retreat direction, it moves back without being engaged with the connected fasteners 40. Thus, the positions of the connected fasteners 40 remain unchanged.

When the air pressure reduces after the fastener injection, since a spring (not shown) provided in the fastener supply mechanism 20 energizes the feed member 21 in the return direction, the feed member 21 is caused to slide forward (a direction to feed the connected fasteners 40) by the force of this spring. In this case, the feed member 21 grips and feeds the second fastener B forward. When the feed member 21 feeds the connected fasteners 40 normally, the first fastener A is fed into the injection passage 13, thereby ending the feed operation.

On the feed member 21, as shown in FIG. 3, there are projectingly provided four feed teeth (first feed tooth 22, second feed tooth 23, third feed tooth 24, and fourth feed tooth 25) engageable with the rear portions of the fasteners 41 to feed out them into the injection passage 13*b*, three front teeth (first front tooth 26, second front tooth 27 and third front tooth 28) disposed opposed to the feed teeth and cooperatable with the feed teeth to pick up the fasteners 41, and an auxiliary tooth 29 formed to cover the side portion of the injection passage 13*b* and having a larger width than the feed teeth and front teeth.

Figure 5:
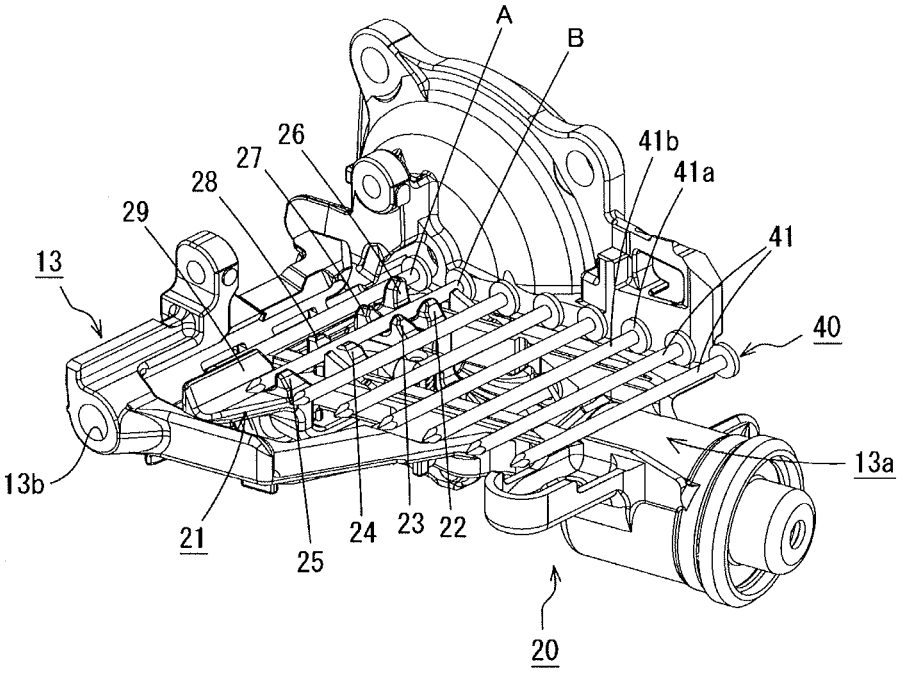
FIG. 5 is a perspective view of a fastener supply mechanism according to a modification.

Here, the auxiliary tooth 29, as shown in FIG. 5, may also be extended to the lower end of the feed member 21. Thus, even when the length of the fastener 41 is long, the fastener 41 can be positively prevented from deviating out of the injection passage from its foot.

Since, of the above teeth, the feed teeth and front teeth are used to feed the fastener 41, they are disposed on the head portion 41*a* of the fastener 41 so as to be able to pick up even the shaft portion 41*b* of a short fastener 41. On the other hand, since the auxiliary tooth 29 is used to guide the first fastener A driven out in such a manner to prevent it from deviating from the injection passage 13*b* and also to close the injection passage 13*b*, it is disposed on the foot side of the fastener 41. Specifically, the auxiliary tooth 29 is disposed nearer to the foot side than a connecting portion (not shown) formed between the upper portions of the connected fasteners and the intermediate portions thereof, and is extended more than the feed teeth and front teeth down to the foot side of the fastener. Since the auxiliary tooth 29 is disposed on the foot side of the fastener 41 in this manner, even when the fastener 41 is driven out obliquely, the foot of the fastener 41 is prevented from deviating out of the injection passage 13*b*.

The auxiliary tooth 29, as shown in FIG. 4, is formed to project more into the supply passage 13*a* than the feed tooth 25.

Figure 4A:
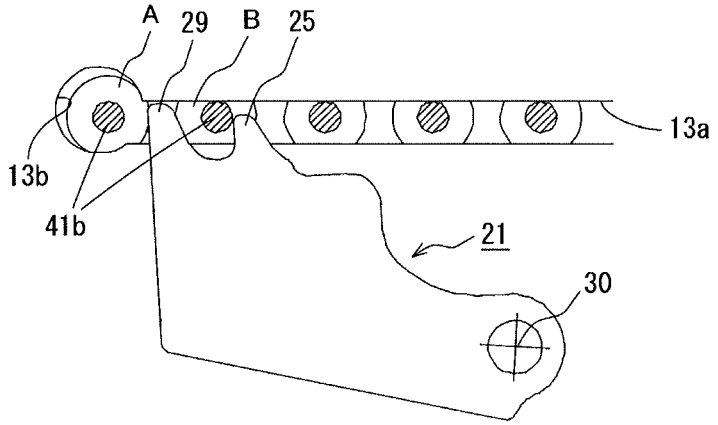
FIGS. 4A, 4B and 4C explain a feed member which oscillates within a fastener supply passage. Specifically.

For example, FIG. 4A shows a state where the fastener 41 is fed normally. In the state of this figure, the feed member 21 oscillates up to the maximum angle in its engaging direction with the fastener 41. In this state, the feed tooth 25 is engaged with the rear portion of the second fastener B and the auxiliary tooth 29 closes the rear portion of the injection passage 13*b*, thereby preventing the first fastener A within the injection passage 13*b* from deviating from the injection passage 13*b*.

Figure 4B:
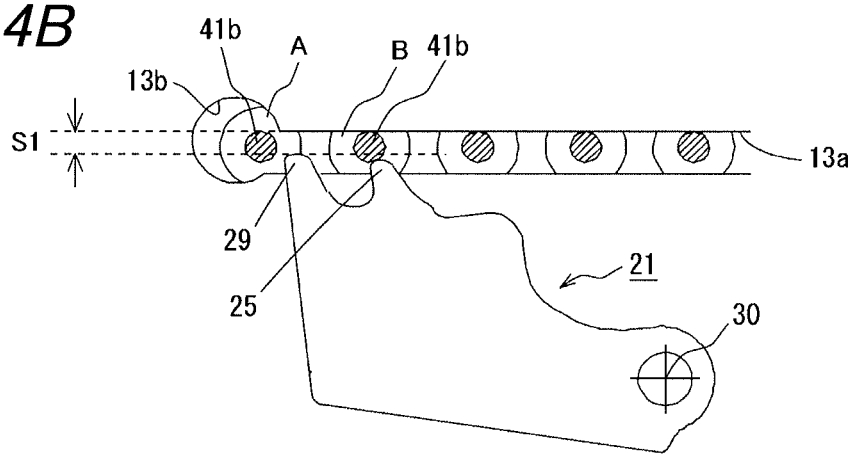

FIG. 4B shows a state where the fastener 41 is fed with the feed tooth 25 moved up on the shaft portion 41*b* of the fastener 41. That is, when the feed member 21 advances and returns in a state where it has not moved back completely, there is a possibility that the feed tooth cannot pick up the second fastener B but the fastener 41 can be fed with the feed tooth moved up on the shaft portion 41*b* of the second fastener 41. FIG. 4B shows a state where the feed tooth 25 has moved up onto the shaft portion 41*b* of the fastener 41. In this state, the feed member 21 has oscillated slightly in the retreat direction (a state where the feed tooth is opened). However, since the auxiliary tooth 29 projects more into the supply passage 13 than the feed tooth 25, the first fastener A within the injection passage 13*b* is prevented from deviating from the injection passage 13*b*.

Specifically, when the fastener 41 is fed with the feed tooth 25 moved up on the shaft portion 41*b* of the fastener 41, the maximum clearance between the feed tooth 25 and supply passage 13*a* is the diameter of the shaft portion 41*b* of the fastener 41. And, since the auxiliary tooth 29 projects more into the supply passage 13 than the feed tooth 25, a clearance 51 between the auxiliary tooth 29 and supply passage 13*a* is always smaller than the diameter of the shaft portion 41*b* of the fastener 41. That is, the fastener 41 is prevented from deviating from the clearance between the auxiliary tooth 29 and supply passage 13*a*.

Figure 4C:
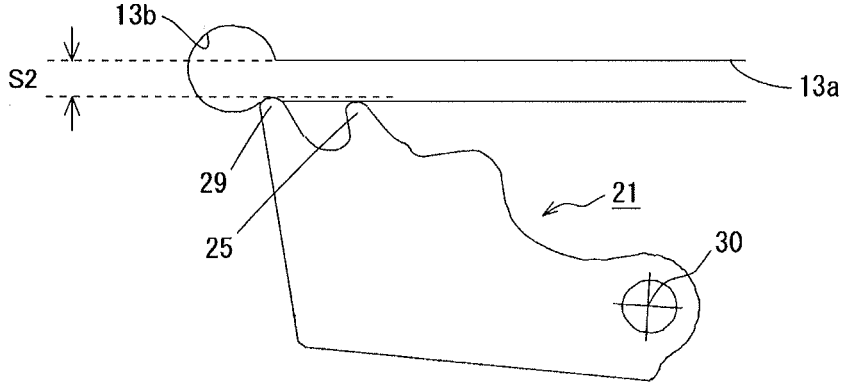

FIG. 4C shows a state where the feed tooth 25 has completely retreated from the supply passage 13*a* of the fasteners 41. As shown here, even when the feed tooth 25 has completely retreated from the supply passage 13*a* of the fasteners 41, the auxiliary tooth 29 is still projecting into the supply passage 13*a*. Therefore, supposing the diameter of the shaft portion 41*b* of the fastener 41 is substantially equal to the width of the supply passage 13*a* (that is, the fastener 41 has the upper limit diameter usable) and the feed tooth 25 has moved up onto the shaft portion 41*b* of the fastener 41, there is formed but a clearance S2 smaller than the diameter of the shaft portion 41*b* of the fastener 41 width of supply passage 13*a*), thereby preventing the fastener 41 from deviating from the clearance between the auxiliary tooth 29 and supply passage 13*a*.

Thus, since the auxiliary tooth 29 is always projecting more into the supply passage 13*a* than the feed tooth regardless of the oscillation position of the feed member 21, even when a fastener 41 used has any diameter, the clearance between the auxiliary tooth 29 and supply passage 13*a* is always smaller than the diameter of the fastener 41, whereby the deviation of the faster 41 can be positively prevented regardless of the diameter of the fastener 41.

What is claimed is:

1. A fastener driving tool, comprising:

a nose portion that includes an injection passage for injecting a fastener;

a supply passage that is connected to the injection passage; and a fastener supply mechanism that feeds connected fasteners loaded into the supply passage to the injection passage, wherein the fastener supply mechanism includes a feed member which advances and retreats in a feed direction of the connected fasteners and which oscillates in a direction to retreat from the supply passage, the feed member includes a feed tooth which extends to a rear portion of the fastener and which feeds out the fastener to the injection passage by engaging with the rear portion of the fastener in the feed direction and an auxiliary tooth which is disposed on a foot side of the fastener to prevent the fastener from deviating from the injection passage, and when the feed tooth of the feed member projects into the supply passage, the auxiliary tooth projects further into the supply passage than the feed tooth.

2. The fastener driving tool according to claim 1, wherein the auxiliary tooth is disposed nearer to the foot side of the fastener than a connecting portion of the connected fasteners.

3. The fastener driving tool according to claim 1, wherein the auxiliary tooth extends to the foot side of the fastener with respect to the feed tooth.

* * * * *